US009617837B2

(12) United States Patent
Vincent et al.

(10) Patent No.: US 9,617,837 B2
(45) Date of Patent: Apr. 11, 2017

(54) HYDRAULIC OIL WELL PUMPING APPARATUS

(71) Applicant: Lufkin Industries, Inc., Lufkin, TX (US)

(72) Inventors: Kenneth H. Vincent, Carencro, LA (US); Joel Lasseigne, Youngsville, LA (US)

(73) Assignee: Lufkin Industries, LLC, Lufkin, TX (US)

( * ) Notice: Subject to any disclaimer, the term of this patent is extended or adjusted under 35 U.S.C. 154(b) by 442 days.

(21) Appl. No.: 14/154,798

(22) Filed: Jan. 14, 2014

(65) Prior Publication Data

US 2014/0196907 A1 Jul. 17, 2014

Related U.S. Application Data

(60) Provisional application No. 61/752,295, filed on Jan. 14, 2013.

(51) Int. Cl.
*E21B 43/12* (2006.01)

(52) U.S. Cl.
CPC ..... *E21B 43/127* (2013.01)

(58) Field of Classification Search
CPC ..... E21B 43/129
See application file for complete search history.

(56) References Cited

U.S. PATENT DOCUMENTS

| | | | | |
|---|---|---|---|---|
| 3,726,093 | A | 4/1973 | Malott | |
| 4,098,340 | A * | 7/1978 | Steele | E21B 37/00 166/311 |
| 4,320,799 | A | 3/1982 | Gilbertson | |
| 4,430,924 | A | 2/1984 | Dunn et al. | |
| 4,480,685 | A | 11/1984 | Gilbertson | |
| 4,490,097 | A | 12/1984 | Gilbertson | |
| 4,503,752 | A | 3/1985 | Olson et al. | |
| 4,571,939 | A | 2/1986 | Dollison | |
| 4,631,918 | A | 12/1986 | Rosman | |
| 4,646,517 | A | 3/1987 | Wright | |
| 4,646,518 | A | 3/1987 | Hochsattel | |
| 4,691,511 | A | 9/1987 | Dollison | |
| 4,761,120 | A | 8/1988 | Mayer et al. | |

(Continued)

FOREIGN PATENT DOCUMENTS

| | | |
|---|---|---|
| WO | WO 2007/090193 A2 | 8/2007 |
| WO | WO 2009/097338 A2 | 8/2009 |

OTHER PUBLICATIONS

Variable Displacement Piston Pumps Series PAVC, Catalog HY28-2661-CD/US, pp. 1-46, Parker Hannifin Corporation, Hydraulic Pump Division, Marysville, Ohio, USA.

*Primary Examiner* — Robert E Fuller
*Assistant Examiner* — Steven MacDonald
(74) *Attorney, Agent, or Firm* — Crowe & Dunlevy, P.C.

(57) ABSTRACT

A hydraulic oil well pumping arrangement employs a compensating type hydraulic pump, a directional valving arrangement and a proportioning valving arrangement. When the directional valve is energized, oil is directed to the rod end of the hydraulic cylinder. In one embodiment, a time delay halts the movement of the sucker rod or pumping string to allow accumulation of oil in a slow following well. In another embodiment, the pumping string rapidly falls to the bottom of the stroke in order to shake or jar debris from the string.

3 Claims, 6 Drawing Sheets

(56) References Cited

U.S. PATENT DOCUMENTS

| | | | | |
|---|---|---|---|---|
| 5,143,153 | A | 9/1992 | Bach et al. | |
| 5,390,743 | A | 2/1995 | Giannesini | |
| 5,996,688 | A | 12/1999 | Schultz et al. | |
| 6,015,271 | A | 1/2000 | Boyer et al. | |
| 6,017,198 | A | 1/2000 | Traylor et al. | |
| 6,394,461 | B1 | 5/2002 | Henderson | |
| 6,595,280 | B2 | 7/2003 | Traylor | |
| 6,857,474 | B2 | 2/2005 | Bramlett et al. | |
| 7,212,923 | B2 | 5/2007 | Gibbs et al. | |
| 7,547,196 | B2 | 6/2009 | Boyer et al. | |
| 7,762,321 | B2 | 7/2010 | Fesi et al. | |
| 7,870,900 | B2 | 1/2011 | Dorado et al. | |
| 8,036,829 | B2 | 10/2011 | Gibbs et al. | |
| 8,066,496 | B2 | 11/2011 | Brown | |
| 8,235,107 | B2 | 8/2012 | Fesi et al. | |
| 8,240,221 | B2 | 8/2012 | Simpson et al. | |
| 2003/0085036 | A1 | 5/2003 | Curtis et al. | |
| 2004/0007392 | A1* | 1/2004 | Judge | E21B 21/001 175/206 |
| 2005/0155758 | A1 | 7/2005 | Webb et al. | |
| 2007/0261841 | A1* | 11/2007 | Fesi | E21B 43/126 166/105 |
| 2008/0135259 | A1 | 6/2008 | Brown | |
| 2008/0314581 | A1 | 12/2008 | Brown | |
| 2009/0139724 | A1* | 6/2009 | Gray | E21B 23/04 166/345 |
| 2009/0194291 | A1 | 8/2009 | Fesi et al. | |
| 2011/0091335 | A1* | 4/2011 | Ehimeakhe | E21B 43/127 417/297 |
| 2012/0328457 | A1 | 12/2012 | Brown | |

* cited by examiner

HYDRAULIC OIL WELL PUMPING APPARATUS

CROSS REFERENCE TO RELATED APPLICATIONS

The present application claims the benefit of and priority to U.S. Provisional Patent Application Ser. No. 61/752,295, filed Jan. 14, 2013, and the contents of which are hereby incorporated by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

The present invention relates to oil well pumps and more particularly to an improved hydraulic oil well pump that is electronically controlled using limit or proximity switches to control a valving arrangement that eliminates shock or excess load from the pumping string or sucker rod during pumping, and especially when changing direction of the sucker rod at the bottom of a stroke. In one embodiment, a time delay halts the movement of the sucker rod or pumping string to allow accumulation of oil in a slow following well. In another embodiment, the pumping string rapidly falls to the bottom of the stroke in order to shake or jar debris from the string.

BRIEF SUMMARY OF THE INVENTION

The present invention provides a hydraulic oil well pumping apparatus. The system of the present invention utilizes a hydraulic cylinder having a piston or rod that is movable between upper and lower piston positions. A pumping string or sucker rod extends downwardly from the piston, the pumping string or sucker rod being configured to extend into an oil well for pumping oil from the well.

A prime mover such as an engine is connected to a compensating type hydraulic pump.

A directional control valve moves between open flow and closed flow positions. A hydraulic flow line connects the pump and the hydraulic cylinder.

Electronic controls are provided that control movement of the piston as it moves between the upper and lower positions.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
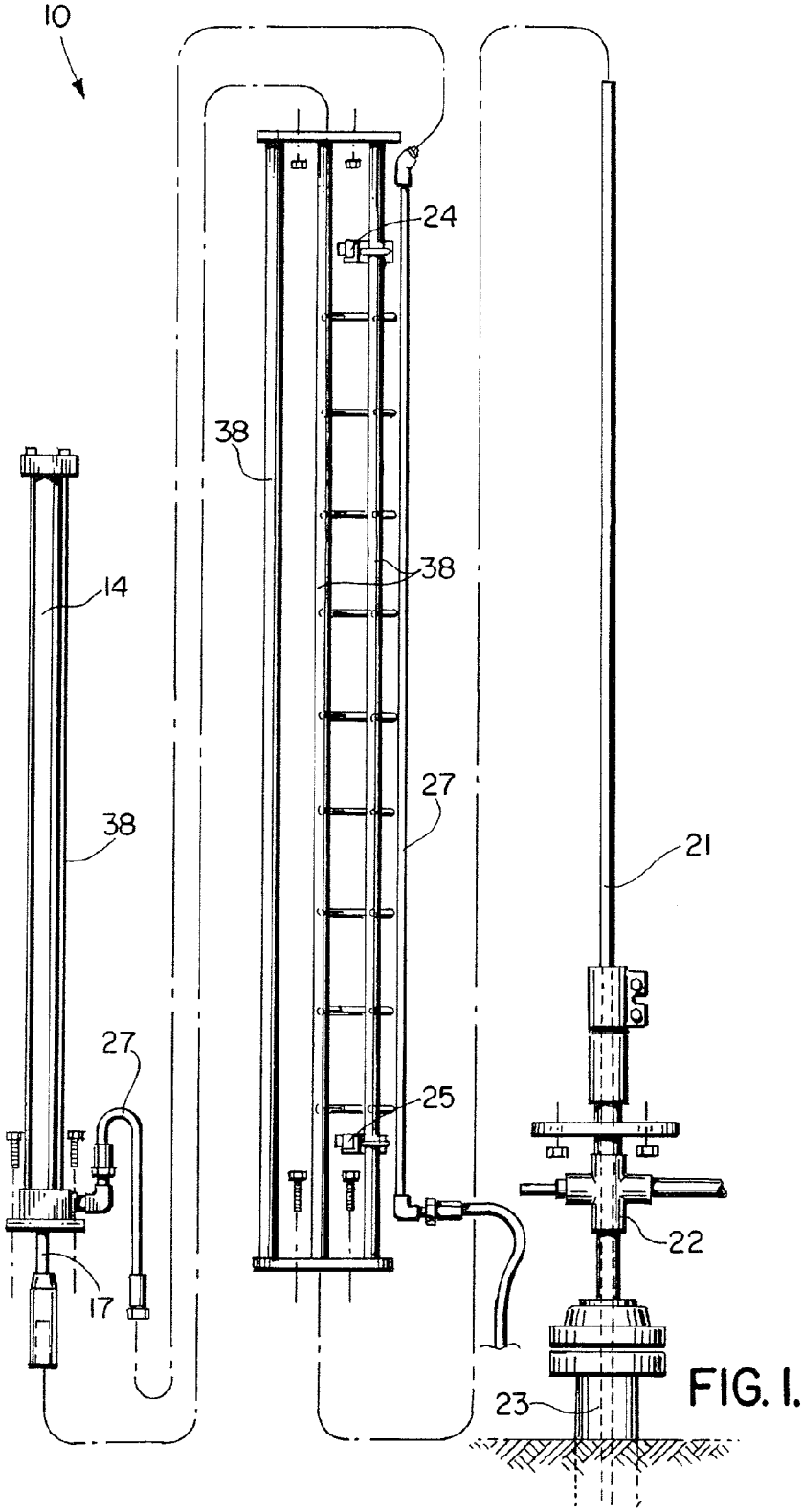
FIG. 1 is an exploded, elevation view of the preferred embodiment of the apparatus of the present invention.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

FIGS. 1-7 show generally the preferred embodiment of the apparatus of the present invention designated generally by the numeral 10.

Oil well pump 10 provides a reservoir 11 for containing hydraulic fluid. A prime mover 12 such as an engine is provided for driving a compensating pump 13. The pump 13 is used to transmit hydraulic pressure, pressurized hydraulic fluid received from reservoir 11 via flow line 33 to a hydraulic cylinder or petroleum lift cylinder 14. Lift cylinder 14 can be a Parker (www.parker.com) model GG699076A0. The hydraulic lift cylinder 14 includes a cylinder body 15 having a hollow interior 16.

A cylinder rod 17 is mounted in sliding or telescoping fashion to the cylinder body 15 extending into the interior 16 of cylinder body 15. The cylinder rod 17 has an upper end portion 18 and a lower end portion 19. During use, the lower end portion 19 extends below cylinder body 15 as shown in FIGS. 1-4C and 6-7.

In FIG. 1, the lower end portion 19 of cylinder rod 17 is attached with coupling 20 to a pumping string or sucker rod 21. The pumping string or sucker rod 21 is comprised of a number of joints, connected end to end. A pumping part of the sucker rod 21 is generally positioned next to a perforated zone of the well. Such a pumping string 21 or sucker rod 21 is known in the art and is used to pump oil from an oil well as the sucker rod 21 moves up and down.

The lift cylinder 14 is mounted upon Christmas tree 22. The Christmas tree 22 is mounted at the well head of an oil well at the upper end portion of well pipe 23. A suitable structural frame 38 can be used for supporting hydraulic cylinder 14 and its cylinder rod 17 above Christmas tree 22 as shown in FIGS. 1-4C and 6-7.

Figure 2:
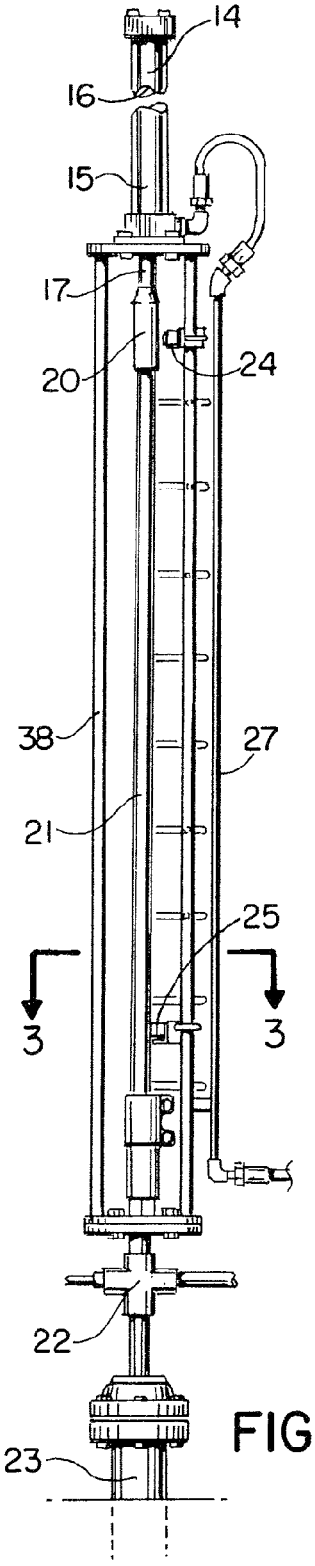
FIG. 2 is an elevation view of the preferred embodiment of the apparatus of the present invention.
Figure 3:
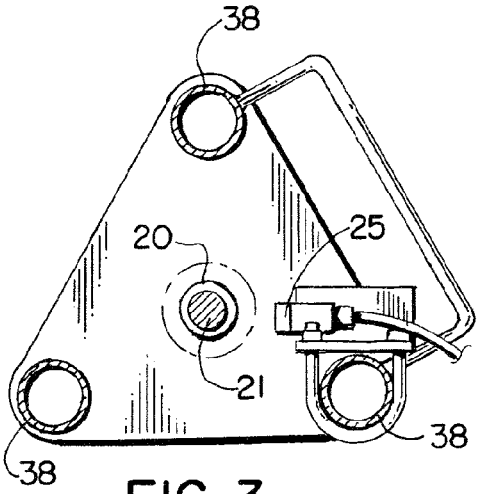
FIG. 3 is a sectional view of the preferred embodiment of the apparatus of the present invention, taken along lines 3-3 of FIG. 2.
Figure 2A:
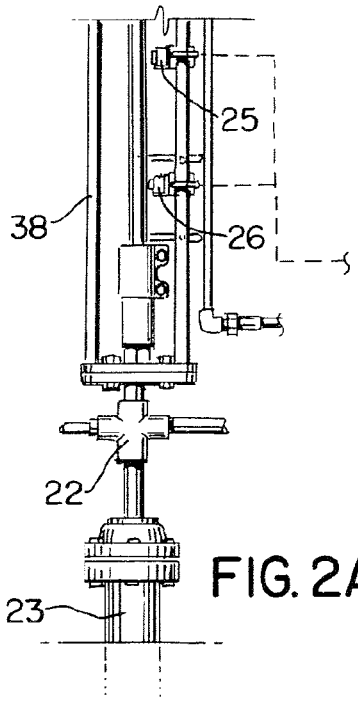
FIG. 2A is a partial elevation view of the preferred embodiment of the apparatus of the present invention.

A plurality of proximity or limit switches 24, 25, 26 are provided. Switches 24, 25, 26 can be for example those manufactured by Turck Company, model number N120-CP40AP6X2/510. As shown in FIGS. 2-2A, these proximity or limit switches 24, 25, 26 can be mounted to frame 38. During use, these proximity or limit switches 24, 25, 26 can be used to sense the position of the lower end portion 19 of cylinder rod 17 and then send an electronic signal to the controller 39 (commercially available), then the controller 39 sends a signal to the manifold 35 that includes directional valve 28, proportioning valve 31, and ventable relief valve 37 (e.g. Parker Sterling model no. AO4H3HZN).

Hydraulic fluid flow lines are provided for transmitting hydraulic fluid under pressure to hydraulic lift cylinder 14 via flow lines 27, 29. Directional valve 28 receives flow from flow line 29. Flow line 27 extends between directional valve 28 and cylinder 14. To initiate operation, pump 13 transmits fluid flow through the manually vented relief valve 37 thus removing pressure from the system prior to start up. When the engine or prime mover 12 is started, it activates the hydraulic pump 13, flow still initially traveling through the relief valve 37 and flow line 34 to reservoir 11.

The cycle of operation begins by vent closure of valve 37 so that oil flowing in flow line 29 now travels to directional valve 28. At about the same time, the directional valve 28 is energized so that oil under pressure is directed via flow line 27 to hydraulic lift cylinder 14 body 15 and its hollow interior 16. The cylinder rod 17 will then elevate, lifting the pumping string 21 or sucker rod 21 with it (see FIG. 2). In one embodiment, a delay cycle is provided wherein the cylinder rod 17 and pumping string 21 remain in this elevated position for a selected time interval. This time delay in the elevated position is used when the well is slow flowing. A well can be slow flowing when the oil is more viscous or if the well is an older well with a lesser volume of available oil to pump. The delay cycle must first be turned on via the HMI (human machine interface). Once this is done the operator can adjust the amount of time that the cylinder pauses (delays) at the top of the stroke. The amount of time of the delay may be 0 seconds to 65000 seconds (18 hours). This can be changed if needed. The delay cycle offers several benefits. The delay cycle allows gas separation at the down hole pump intake—resulting in greater pump efficiency. The delay cycle minimizes rod reversal effect, which allows the rod time to relax before starting its downward stroke. The delays also allows the tubing fluid load above the travel valve time to equalize with the standing valve—resulting in reduced fluid pound effect at the down hole rod pump.

Frame 38 carries the plurality of proximity or limit switches 24, 25, 26. When the cylinder rod 17 reaches the top of its stroke, the proximity switch 24 (which is an uppermost proximity switch) senses the position of coupling 20 and energizes the directional valve 28 so that it closes the flow line 29 and flows through proportional valve 31. Valve 31 is a manual proportional valve with flow check for restricted flow on return of hydraulic oil to the reservoir, thus allowing a restricted flow to control the rate of descent of cylinder rod 17. Because the pump 13 is a compensating pump, it continues to run but does not continue to pump fluid. It can be set to halt fluid flow at a certain pressure value (e.g. 3000 psi, or 210.92 kgf/cm2) which can be set by design depending upon the weight of sucker rod 21. In other words, pump 13 is volume compensating and pressure responsive. Such a compensating pump is manufactured by Parker such as their model no. P1100PSO1SRM5AC00E1000000.

When the directional valve 28 is used to close flow line 29, the compensating pump 13 continues to rotate with the engine 12 but no longer pumps fluid in flow line 29. The directional valve 28 opens drain line 30 at about the same time that line 29 is closed. Fluid in hydraulic cylinder 14 now drains via flow lines 27 and 30 through proportioning valve 31 and cylinder rod 17 descends relative to cylinder body 15. The hydraulic fluid draining from cylinder body 15 interior 16 continues to flow via flow lines 27 and 30 through proportioning valve 31 and cooler 36 and then into flow line 32 which is a drain line to reservoir 11. The flow line 32 can be provided with oil cooler 36 (e.g. Thermal Transfer model BOL-8-1-9) and an oil filter (e.g. Parker model no. RF2210QUP35Y9991) if desired.

Figures 4A, 4B, 4C:
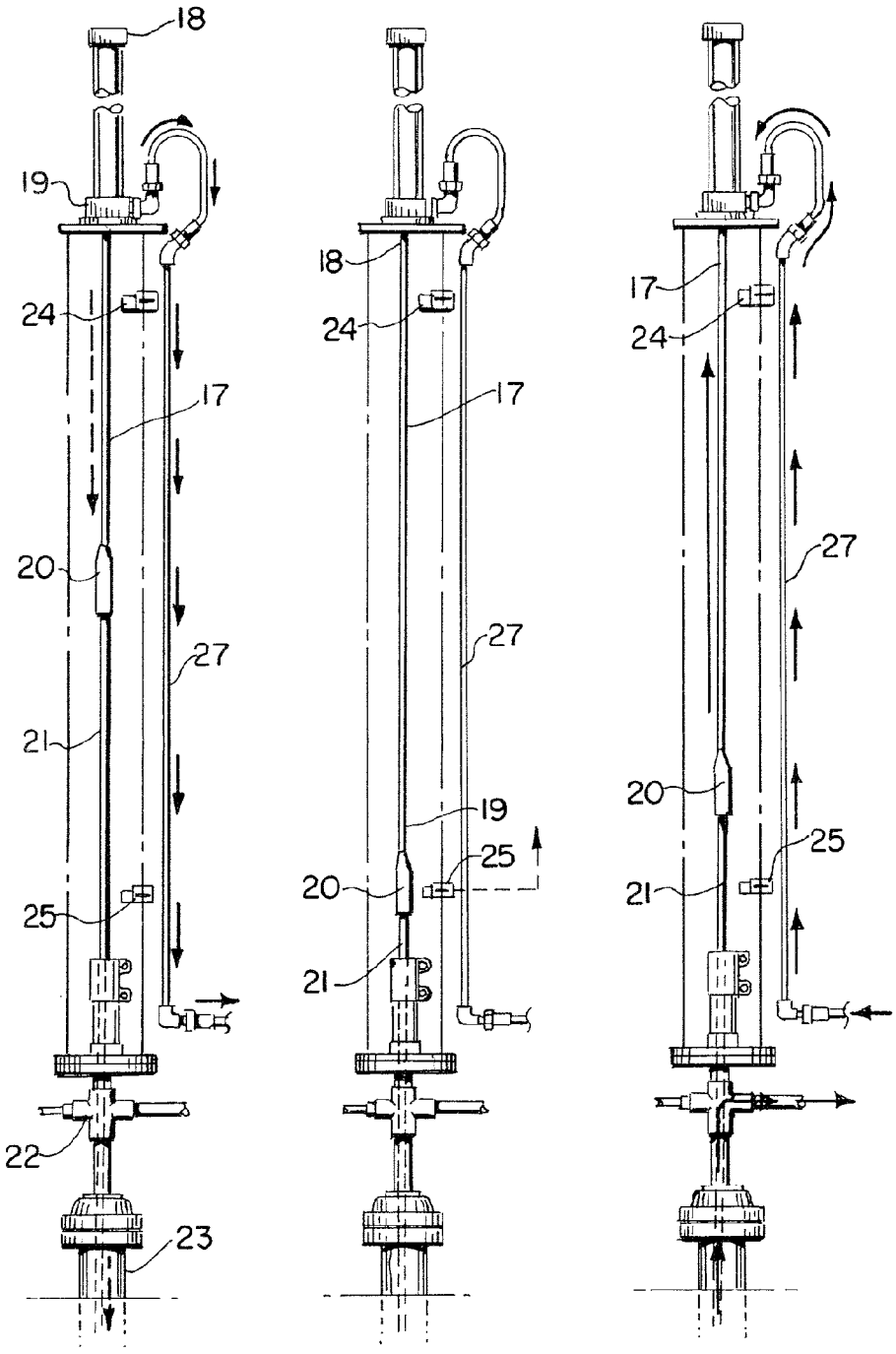
FIGS. 4A, 4B and 4C are fragmentary, elevation views of the preferred embodiment of the apparatus of the present invention illustrating operation of the apparatus.
Figure 5:
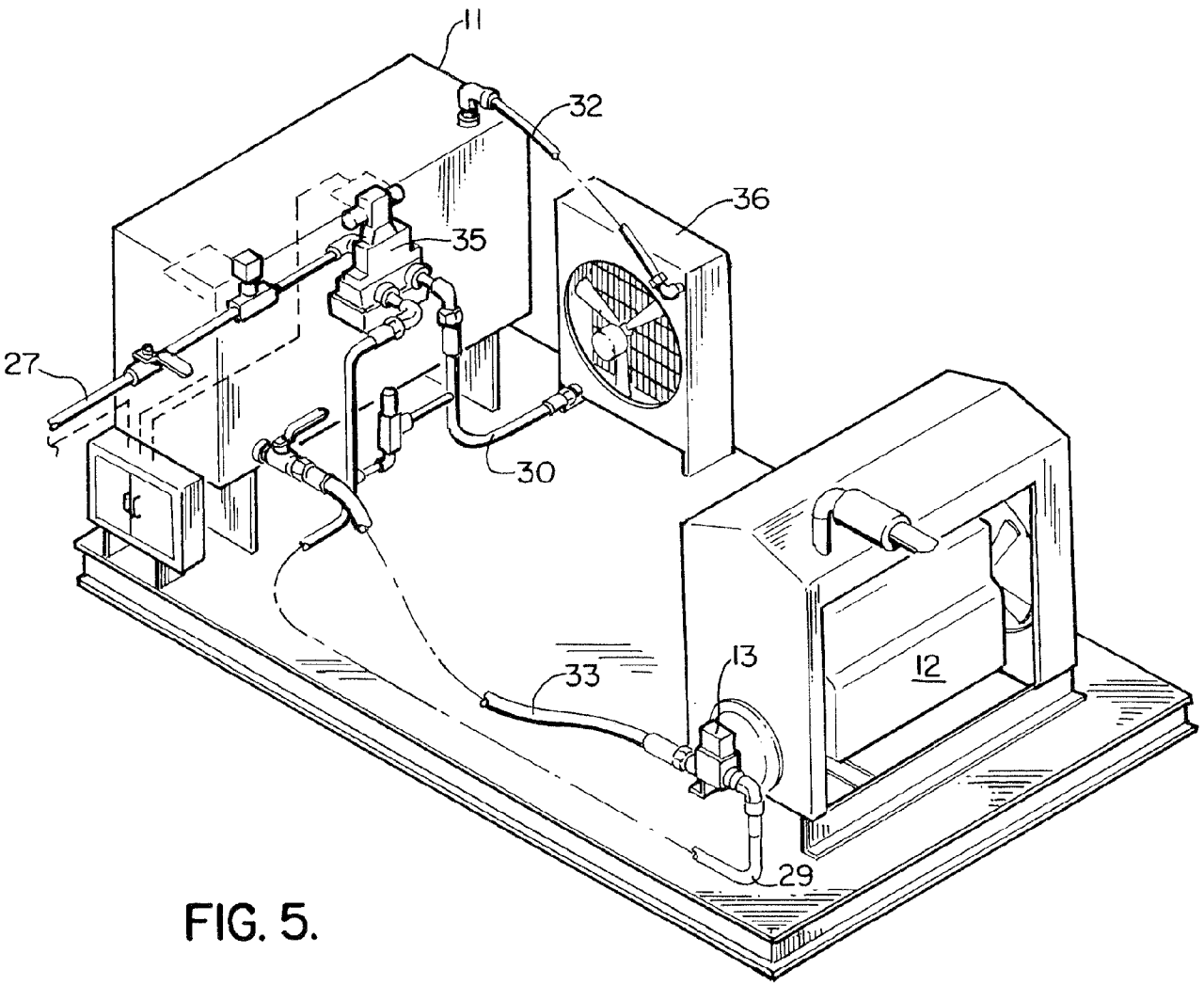
FIG. 5 is a partial perspective view of the preferred embodiment of the apparatus of the present invention.
Figure 6:
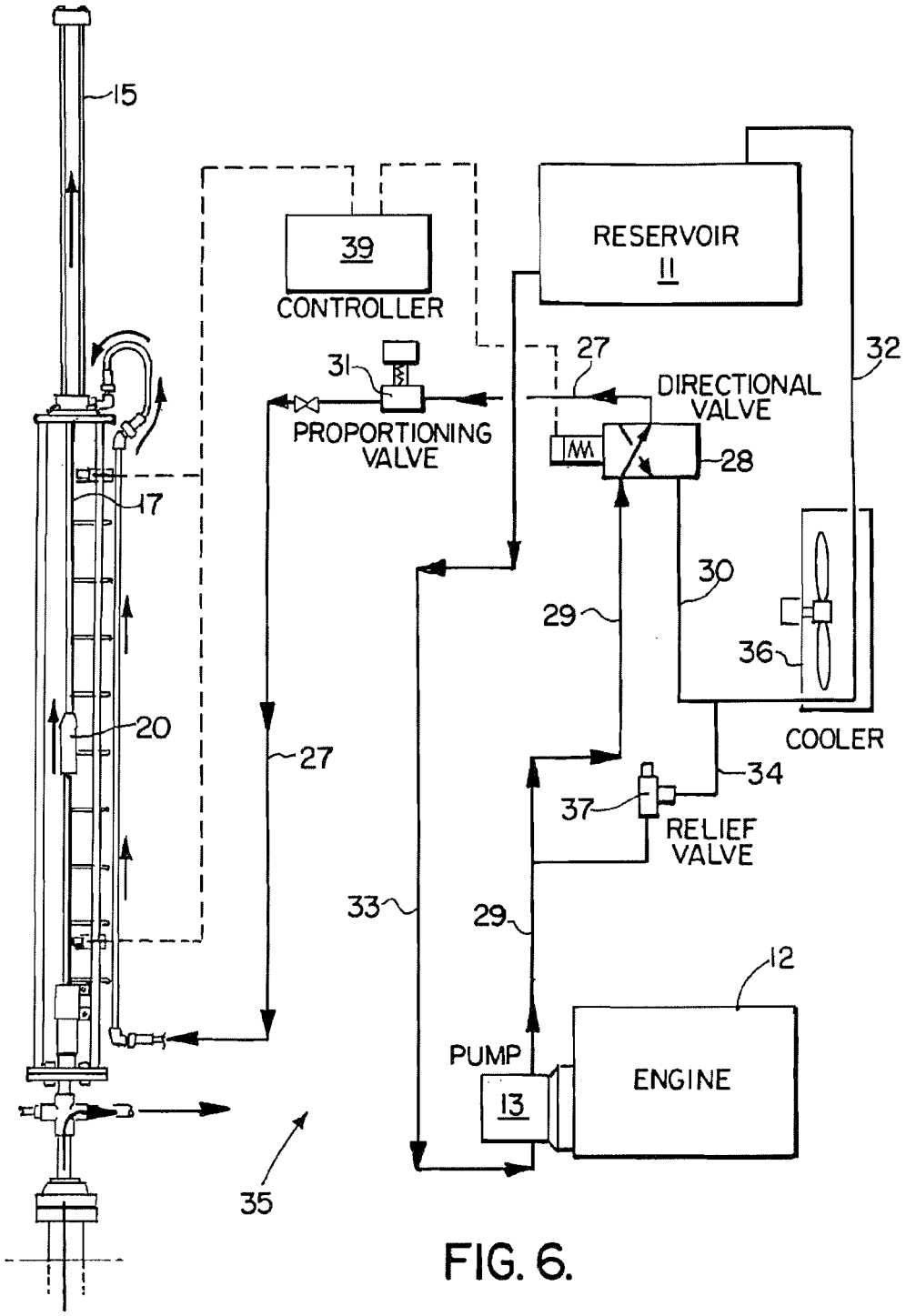
FIGS. 6-7 are schematic diagrams of the preferred embodiment of the apparatus of the present invention.
Figure 7:
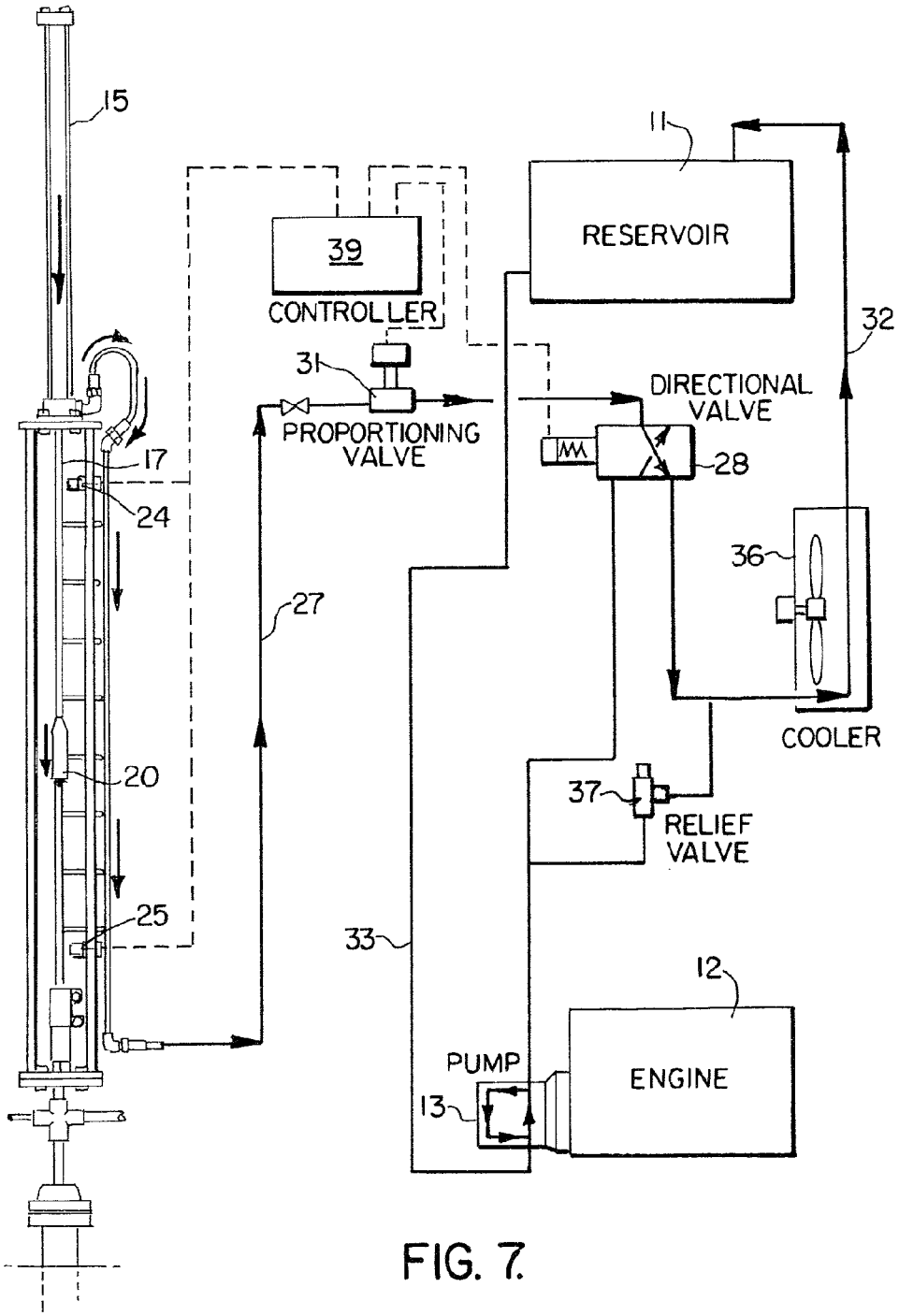

Since pressure no longer forces cylinder rod 17 upwardly, it begins to drop (see FIGS. 4A and 7). As it drops relative to lift cylinder body 15, coupling 20 will meet a second proximity or limit switch 25 which is below limit switch 24 (see FIGS. 2, 4A, 4B, 4C). The limit switch 25 is closer to the lower end portion (for example, 1 foot, or 0.30 meters) of cylinder body 15 than to upper end portion of body 15. When the coupling 20 reaches proximity or limit switch 25, in one embodiment (FIG. 2A) it signals the directional valve 28 that it should switch to allow the flow of fluid to travel through the proportioning valve 31 via flow lines 27, 30.

The proportioning valve 31 is a manual proportioning valve with flow check for restricted flow on return of hydraulic oil to the reservoir. When the coupling 20 reaches the proximity or limit switch 25, the directional valve switches to direct the flow to lift the cylinder 14. The choking action that takes place in the proportioning valve 31 has the effect of gradually slowing the speed of the cylinder rod 17 and its connected sucker rod 21. The use of Parker No. FMDDDSM Manapac manual sandwich valve located between directional valve and the solenoid controls dampens the transition of the directional valve from the upstroke or downstroke to allow bumpless transfer of fluid to the cylinder 14 and balances pressures. This choking of flow by the proportioning valve 31 also slows action of cylinder rod 17, preventing undue stress from being transmitted to the sucker rod 21 as the bottom of the downstroke of cylinder rod 17 is approached, then reached.

Directional valve 28 can be a Parker® valve model number D61VW001B4NKCG. Proportioning valve 31 can be a Parker® valve model number DFZ01C600012.

In one embodiment, the cylinder rod 17 and pumping string 21 are allowed to fall without any slowing. This free fall of rod 17 and string 21 from the elevated position to the rod 17 lowest position. Such free fall creates a jar or shock that dislodges any trash or unwanted debris from the string 21. The operator turns the clean cycle on via the HMI. After the clean cycle is turned on, the next stroke down will perform the clean function event. The event starts by pumping the cylinder to the top of the stroke. For the current embodiment, it goes to the top switch. After reaching the top switch the down stroke for the clean out cycle begins. The bypass valve opens and the direction valve closes (resulting in the pump de-stroking to bypass pressure). The proportional valve ramps open to 75%, and the cylinder is drained resulting in the down stroke. The middle switch is ignored (this is unique for this function). When the bottom switch is detected the proportional valve is shut closed (not ramped; also unique). This has the benefit of creating a gentler "abrupt" stop by closing the proportional valve very quickly (not ramping it closed). This triggers the end of the clean out cycle. The function is turned off and the normal cycle resumes. Alternatively, the step requiring an operator to turn the cleaning cycle on may be eliminated, and this cleaning or cleanout cycle may be scheduled to automatically occur at a selected interval.

In one embodiment, an improved direct mount smart cylinder that does not use proximity switches may be used with an oil well pump, including sucker rod pumping. As a result, this embodiment does not require the use of a pedestal, though one may still be used if warranted. A linear displacement transducer may be installed inside the direct mount smart cylinder in order to measure the linear displacement of the rod of the oil well pump. The direct mount smart cylinder is able to determine the position of the rod without the use of proximity switches. A hall effects linear displacement transducer may be used.

The direct mount smart cylinder embodiment offers several benefits. It minimizes the possible points of oil leaks because a stuffing box is no longer needed. The height of the oil well pump may be reduced by half when a direct mount smart cylinder is implemented. The connection to the well is improved because no guy wires are used with the direct mount smart cylinder. The direct mount smart cylinder provides the position through the stroke instead of only at the location of the proximity switches. Because only one cable runs to the linear displacement sensor instead of multiple proximity sensors, the assembly of the oil well pump is easier and is safer because there are fewer loose electronics. The stroke length may be changed through the control system human machine interface without having to move proximity sensors. There are fewer or no moving parts in sight on the wellhead. The linear displacement transducer is a no wear item. The direct mount smart cylinder embodiment also increases the ability to change the speed on the fly.

Other and further embodiments utilizing one or more aspects of the inventions described above can be devised without departing from the spirit of Applicant's invention. Discussion of singular elements can include plural elements and vice-versa.

The order of steps can occur in a variety of sequences unless otherwise specifically limited. The various steps described herein can be combined with other steps, interlineated with the stated steps, and split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A method of controlling a hydraulic oil well pumping apparatus mounted to a wellhead above an oil well, wherein the hydraulic oil well pumping apparatus comprises at least two modes of operation, the method comprising the steps of:

a) providing a hydraulic cylinder having a hydraulic cylinder rod that is movable between an upper rod position and a lower rod position, wherein the hydraulic cylinder rod is connected to a sucker rod that extends into the oil well;

b) providing a control system that controls movement of the hydraulic cylinder rod as it moves between the upper and lower rod positions, wherein the control system includes a proportional valve that controls the rate of flow of hydraulic fluid to and from the hydraulic cylinder and wherein the control system further includes a directional valve that diverts hydraulic fluid to and from the hydraulic cylinder;

c) operating the hydraulic oil well pumping apparatus according to a normal pumping mode of operation comprising the steps of:

c1) directing hydraulic fluid into the hydraulic cylinder to lift the hydraulic cylinder rod to the upper rod position;

c2) opening the proportional valve to allow the hydraulic cylinder rod to fall;

c3) slowly closing the proportional valve as the hydraulic cylinder rod approaches the lower rod position to gradually stop the downward motion of the hydraulic cylinder rod; and c4) repeating steps c1-c4 until a cleaning cycle is requested; and d) operating the hydraulic oil well pumping apparatus according to a cleaning cycle mode of operation comprising the steps of:

d1) directing hydraulic fluid into the hydraulic cylinder to lift the hydraulic cylinder rod to the upper rod position;

d2) opening the proportional valve to allow the hydraulic cylinder rod to fall;

d3) rapidly closing the proportional valve as the hydraulic cylinder rod approaches the lower rod position to rapidly stop the downward motion of the hydraulic cylinder rod; and d4) returning the hydraulic oil well pumping apparatus to the normal pumping mode of operation comprising of steps c1-c4.

2. The method of claim 1, wherein step d4 occurs immediately after step d3.

3. The method of claim 1, wherein step d2 comprises ramping open the proportional valve to 75%.

* * * * *